United States Patent [19]

Southmayd

[11] Patent Number: 5,036,881

[45] Date of Patent: Aug. 6, 1991

[54] HYDROSTATIC RELIEF VALVE

[76] Inventor: George C. Southmayd, 148 Westport Rd., Wilton, Conn. 06897

[21] Appl. No.: 430,197

[22] Filed: Nov. 1, 1989

[51] Int. Cl.[5] ..... F16K 17/12

[52] U.S. Cl. ..... 137/533.29

[58] Field of Search ..... 137/516.27, 516.29, 137/533.21, 533.29, 533

[56] References Cited

U.S. PATENT DOCUMENTS

| | | | |
|---|---|---|---|
| 1,539,617 | 5/1925 | Williston | 137/516.27 X |
| 1,825,443 | 9/1931 | Chormann | 137/533.29 X |
| 4,276,163 | 6/1981 | Gordon | 137/544 X |
| 4,860,995 | 8/1989 | Rogers | 137/516.29 X |

*Primary Examiner*—Robert G. Nilson

*Attorney, Agent, or Firm*—Philip M. French

[57] ABSTRACT

A system for relieving excess ground water pressure surrounding a swimming pool is disclosed. A one-way flow valve is inserted in the pool enclosure so as to complete a passageway connecting its opposite sides. The valve comprises an elongated plunger slidingly engaged within a sleeve forming a portion of the passageway. The plunger has a tapered conical seating surface radially diagonal to its long axis. The sleeve contains a compatible conical surface such that when the two surfaces meet by sliding engagement of the plunger, the flow of water through the passageway into the pool is closed.

8 Claims, 2 Drawing Sheets

HYDROSTATIC RELIEF VALVE

BACKGROUND OF THE INVENTION

This invention relates to a system for controlling the level of ground water surrounding a swimming pool. More particularly, it relates to a system for balancing the respective levels of water in a pool and the adjacent ground for the protection of the pool.

In many areas of the country, the ground water level is relatively high and close to the surface of the ground. Also, during periods of heavy rain, excessive water can accumulate at or near the level of the ground, depending on local soil types and conditions. These phenomena can result in the ground water level rising to a level which can disrupt an in-ground pool installation. A similar result can occur if a pool is partially or completely emptied, something often necessary for its maintenance.

Where ground water rises to an elevation higher than the level of water in an in-ground pool, hydrostatic pressure can adversely affect the swimming pool structure. In the case of a swimming pool that has a vinyl liner, this condition may cause the liner to displace or float. In the case of concrete or other swimming pools, where exterior hydrostatic pressure becomes excessive it can disrupt the integrity of the swimming pool structure through shifting or dislodging of the wall and/or floor. Further, the pressure can cause the swimming pool to actually raise out of the ground.

The hydrostatic pressure is the result of a difference between the water level external to the swimming pool and its internal water elevation. It is apparent that a need exists for a system to safeguard against or minimize the adverse effects on a swimming pool due to hydrostatic pressure from elevated ground water levels.

This problem has long been recognized and a variety of approaches to its mitigation attempted. In, for example, U.S. Pat. No. 4,060,946, anchors are proposed to stabilize a pool. These "ground" anchors extend from the side of the pool shell or wall into the adjacent ground. Such anchors are said to reinforce the pool structure against the results of hydrostatic forces.

U.S. Pat. No. 4,227,266 discloses a different approach. There, collateral dewatering systems are installed in the ground around a pool. These systems limit the height of adjacent ground water by its direct removal from the environs of the pool. This controls the external hydrostatic pressure to which the pool is exposed.

This same U.S. Pat. No. 4,227,266 also appears to disclose a conventional cap valve at the bottom of some of its depicted pools. Such valves cap a pipe penetrating the pool bottom into the surrounding ground with a simple horizontally seating surface. They are known in the prior art and operate much like the common stopper in a bathroom sink.

Normally, such a cap valve has consisted of a horizontal metal disc attached to a vertical stem. About the bottom surface of the disc circumference there has been a flexible (e.g. rubber) gasket. This gasket seated on a corresponding and horizontal surface on or within the neck of a pipe penetrating into the ground. Such a cap valve was intended to close downwardly, preventing the outflow of water from a pool, while opening to allow a one-way influx of ground water into the pool whenever the hydrostatic pressure exterior of the pool exceeded that within the pool.

These prior art valves have several disadvantages. In particular, normally being mostly metallic, they corrode. Further, the gasket and opening are arranged such that the former frequently is dislodged or falls from its operating position. Lastly, these valves are readily clogged with leaves or other common pool debris and become stuck, often in an open position causing leakage from the pool.

An assembly containing such a prior art hydrostatic relief valve is described in U.S. Pat. No. 3,378,858. The valve, which again is not shown in detail, is located within a housing having a slotted cover.

SUMMARY OF THE INVENTION

The present invention is directed to a novel hydrostatic relief valve system and to assemblies which allow the improved balancing of water pressures within and without an in-ground pool.

In accordance with this invention, one or more improved relief valve assemblies are imbedded within a swimming pool enclosure (i.e. wall or preferably, floor). These assemblies comprise a passageway which penetrates the pool enclosure to connect the exterior ground and interior swimming pool waters. Within this passageway is a valve system in which an elongated plunger is slidingly held within a sleeve. Both the plunger and sleeve possess compatible conical surfaces which are radially aligned, diagonal to the long axis of the plunger and meet to form a seal when the plunger is fully inserted (or engaged with the sleeve) to prevent the outward flow of pool water.

Where the pressure of the ground water exceeds that in the pool, the plunger is pushed inwardly of the pool along its longer axis to open its seal with the sleeve. This allows the influx of ground water, reducing the undesirable pressure differential. The plunger is normally constrained by a retaining means which prevents its complete expulsion from the sleeve so that, when the exterior pressure becomes less than that of the pool, the plunger is pushed or settles into seating position with the sleeve by pressure of the pool water.

A principal object of this invention is to provide a novel and improved valve system for maintaining the exterior ground water pressure of a swimming pool within an acceptable range.

Another object of this invention is to provide a simplified valve construction which is not susceptible to problems of corrosion, breakage and/or blockage common in the prior art.

Yet another object of this invention is to provide a hydrostatic relief valve which operates more efficiently to reduce dangerous ground water pressures surrounding a swimming pool while securely sealing to prevent the outflow of water from the pool.

Further objects and advantages of this invention will be apparent from the following description of preferred embodiments thereof, shown in the accompanying drawings, in which.

Before explaining the disclosed embodiments of the present invention in detail, it is to be understood that this invention is not limited in application to the details of the particular arrangements shown. This invention is capable of many of other embodiments. Also, the terminology used herein is solely for the purpose of description and not of limitation.

Figure 1:
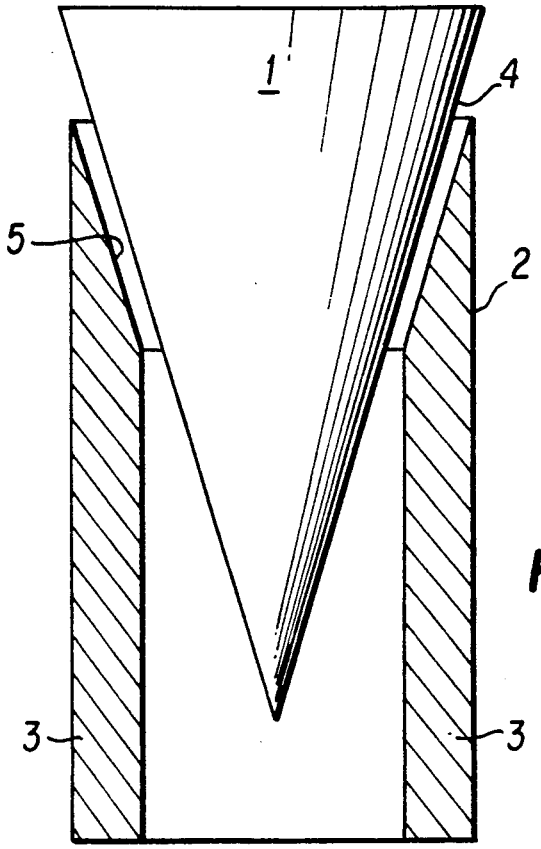
FIG. 1 is a cross-sectional view along the long axis of a hydrostatic relief valve system comprising a plunger and sleeve.

As shown in the valve system of FIG. 1, a plunger 1 having a conical seating surface 4 is located within a sleeve 2, constructed principally as a simple, hollow tube or pipe comprising a continuously curved wall 3 (shown as interrupted and therefore repeated because of the cross-sectional view of the drawing). The wall is internally beveled or champered at one end to form a conical surface 5 compatible with the seating surface 4.

The plunger 1 is at the pool side of the valve. It is shown partially inserted into the compatibly shaped end opening of the sleeve 2. The arrangement of elements 1 and 2 shown is substantially that obtained when the ground water pressure exceeds that of the pool and the valve system is open. The separation of elements allows water to flow from the ground into the pool. Conversely, where the ground water pressure is less than that in the pool, the plunger 1 is moved slidingly along the axis of the sleeve 2, until their surfaces 4 and 5 meet. This closes the valve system, preventing any passage of water.

Figure 2:
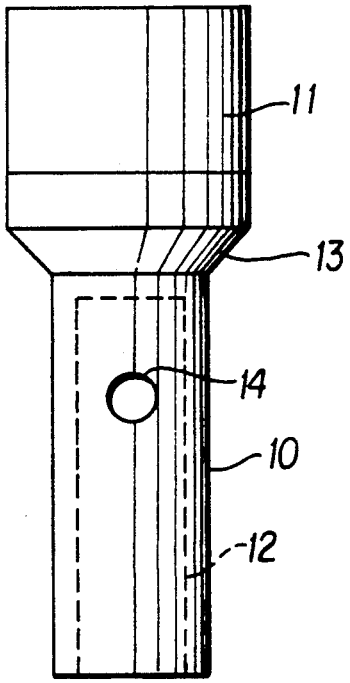
FIG. 2 is side view of a preferred valve plunger.

FIG. 2 shows a preferred plunger 10 of the present invention. The elongated plunger is composed of three sections, the cap 11, the body 12 and an intermediate conical seating portion 13. The cap 11 is usually solid such as plastic to provide a weighted resistance to opening of the valve (not shown in totality). The body 12 is a hollow cylindrical plastic tube having a somewhat smaller diameter than the cap 11. The body 12 is open at its exposed end and through one or more apertures 14 in its surface. This allows the free flow of ground water through the body 12 when the valve is opened by higher ground water pressure.

The middle section 13 of the plunger 10 is beveled to provide for conical seating on the correspondingly beveled surface of a valve sleeve (not shown). Although this section may also be formed of plastic (even being an extension of the cap 11 and/or body 12 sections), it is more desirably composed of rubber or some other flexible substance. Such materials form a tighter seal.

Figure 3:
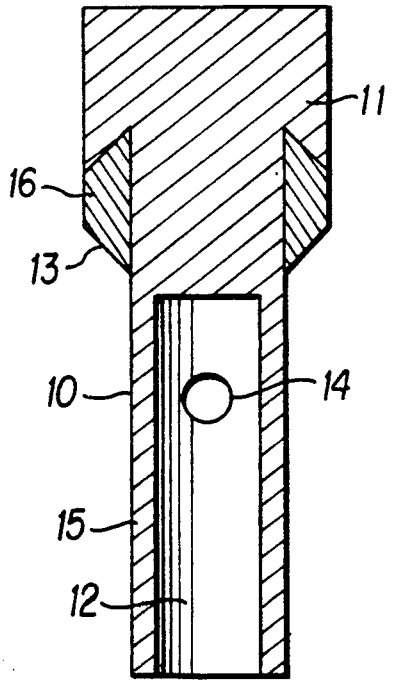
FIG. 3 is a cross-sectional view of the valve plunger of FIG. 2.

This latter embodiment is more specifically depicted in FIG. 3, which shows a cross-section of a preferred embodiment of the plunger of FIG. 2 taken along its long axis. According to FIG. 3, there is a cylindrical rubber gasket 16 about the bottom portion of the cap 11. The exposed edge 13 of the gasket 16 forms the conical surface for seating on a sleeve (not shown) to prevent the outflow of pool water. As is also made clear in FIG. 3, the body 12 is shown as formed by a cylindrical wall 15 containing an aperture 14 to facilitate the flow of water when the valve is open.

This arrangement greatly facilitates the flow of ground water into a pool to reduce exterior hydrostatic pressure. Absent this arrangement, water flow can occur only through an annular ring defined by the opening between the adjacent conical sealing surfaces of the plunger and sleeve. In accordance with this preferred embodiment, however, once the valve is opened to an extent such that the aperture 14 is clear of the sleeve, a second and additional route of flow develops, thus increasing the cross-sectional area through which the water can flow to mitigate the undesirable pressure differential.

This embodiment of the present invention is particularly important under circumstances where the pool is to be drained, for example for cleaning. A very large pressure differential can developed when pool water is removed. To prevent a pool from literally popping out of the ground because of the buoyancy (or hydrostatic pressure) exerted by ground water, large volumes of water must be removed from the ground in a short time. This can readily be achieved only where a relief valve opens sufficiently to permit such a passage of water.

A further advantage of this embodiment is that it creates a self-cleaning action which functions to avoid many prior art clogging problems. Firstly, the large opening and high volume flow over a conical sealing surface permitted by the present valves sweeps the valve free of congestion. Additionally, where the body and sleeve elements of the present invention constitute cylindrical tubes, the outside diameter of the body being slightly less than the inside of the sleeve, a flow of water causes the oscillation or vibration of the plunger. This action tends to dislodge debris in the valve and facilitate its expulsion.

Figure 4:
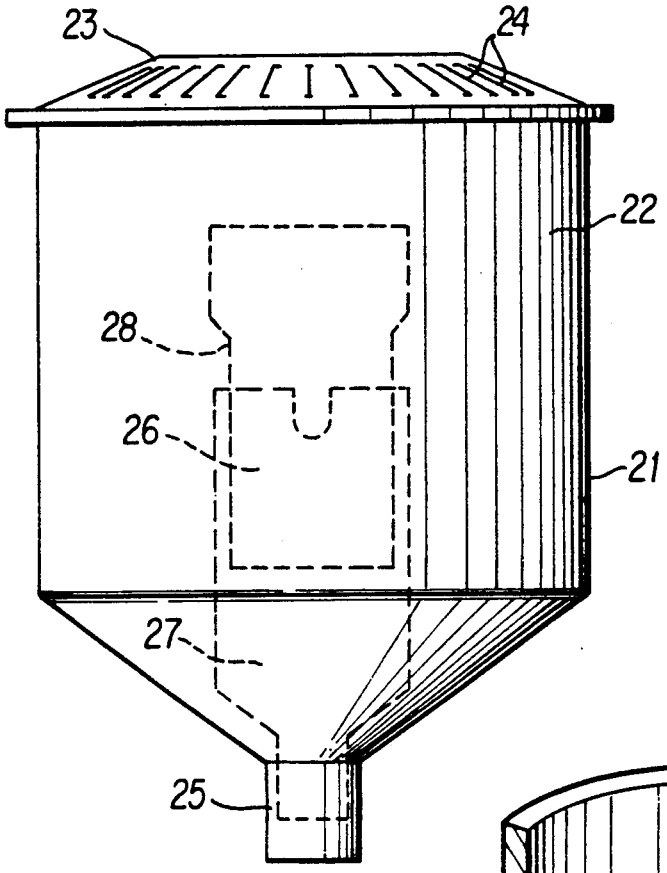
FIG. 4 shows a hydrostatic relief valve assembly comprising a plunger and adapter-sleeve system within a basket retainer.
Figure 5:
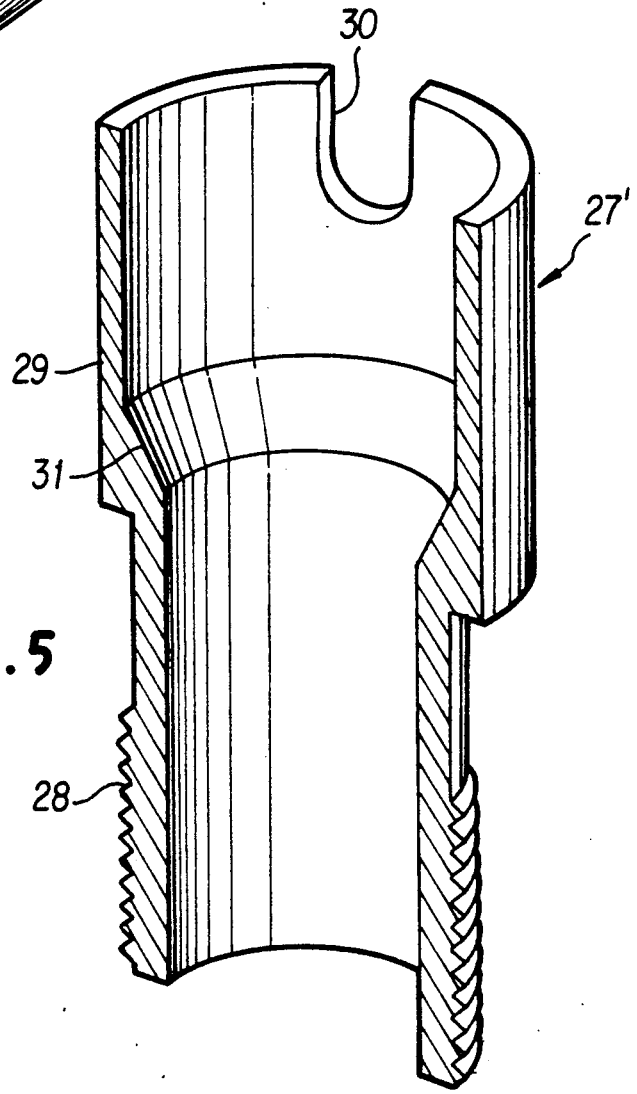
FIG. 5 is a fragmentary cross-sectional view along the long axis of the adapter-sleeve of FIG. 4.

As shown in FIGS. 4 and 5, the present invention can be combined with conventional or related materials to form a protected valve assembly.

Referring to FIG. 4, the assembly 21 is composed of a conventional housing comprising a bowl shaped holder 22 with a lid 23 having multiple apertures 24. The holder 22 also has a pipe 25 penetrating through the swimming pool wall (not shown). This arrangement permits water to pass through the assembly when open.

Interior of the housing 21 is a plunger 26 (shown in dotted outline and such as depicted in FIGS. 2 and 3) and a sleeve adapter 27 (also shown in dotted outlines). The adapter 27 preferably screws into the holder 22 so as to align with the opening of pipe 25. Once connected, the adapter forms part of the water passageway (with pipe 25) and bears an inner conical surface (not shown) for sealing with the corresponding surface 28 of the plunger 26 to close the valve assembly.

In this embodiment, the housing 21 and plunger 26 are configured such that the plunger 26 is physically restrained by the lid 23 from being completely removed from the adapter 27. This restraint prevents any separation of valve parts as might otherwise permit the valve to disconnect ad therefore maintain an open position.

Referring to FIG. 5, the details of configuration and operation of the adapter 27 of FIG. 4 are clarified. The adapter 27' is shown to be a hollow conduit fitted at one end with a threaded portion 28 for fixed engagement to the housing (not shown). At its opposite end, the aperture 27' has a sleeve extension 29 for loosely holding the plunger (not shown). In the extension 29 are one or more depressions 30 which function to assist in screwing the adapter 27' into the housing (not shown) as well as to coordinate with plunger apertures (not shown) to facilitate the flow of water.

On the interior surface of the adapter 27' is a beveled edge 31 forming a conical ring which can seal with the corresponding and parallel seating surface of the plunger (not shown) when the valve is closed.

It is apparent that numerous variations and modifications of the valve systems and assemblies described above may be made without departing from the underlying inventive concept disclosed herein. By way of further example, the parts may be composed of many additional materials. Similarly, they may be located in a swimming pool at different points including the bottom or sides. Finally, other elements, especially a suction or circulation line may be combines within them. The scope of this invention is therefore not to be limited to specifically described embodiments but should be construed with reference to the appended claims.

What is claimed is:

1. A hydrostatic relief valve assembly for a swimming pool comprising a valve system forming at least part of a passageway connecting the interior of said pool with the ground exterior of said pool, said system having an elongated plunger slidingly held within a tubular sleeve forming a portion of said passageway, said plunger having a terminal cap and an outer conical seating surface radially diagonal to its long axis and tapering away from said cap, the portion of said plunger within said sleeve having a diameter less than the inner diameter of said sleeve so as to provide for a route of flow of water through the space between said sleeve and said plunger when the valve is open, said sleeve having an inner compatible conical surface such that, when said surfaces meet, the flow of water through the valve passageway is closed.

2. The assembly of claim 1, wherein the plunger additionally has a body section comprising a tubular cylinder closed at one end by the cap and open at the other, said body having at least one aperture in the cylinder wall intermediate said ends.

3. The assembly of claim 2, wherein a flexible gasket circumscribes the plunger, said gasket forming a conical seating surface of said plunger.

4. The assembly of claim 2, wherein the valve system is contained within a housing configured such that the plunger is physically constrained from being slidingly removed from the sleeve.

5. The assembly of claim 4, wherein said assembly additionally contains an adapter comprising a hollow conduit fixedly engaged at one end to the housing, said conduit forming at least a portion of the passageway, the other end of said conduit forming the sleeve, an intermediate portion of the inner surface of said adapter being beveled to form the conical surface compatible with the plunger seating surface.

6. The assembly of claim 5, wherein the outer diameter of the plunger body is slightly less than the inner diameter of the sleeve within which it is slidingly held.

7. The assembly of claim 2, wherein the aperture is positioned on the cylinder wall such that, when the plunger is slidingly extended from the sleeve to open the valve, a second route of flow of water is provided through the interior of said plunger and then out the aperture at a point beyond the inner compatible conical surface of said sleeve.

8. The assembly of claim 5, wherein the sliding movement of the plunger within the sleeve to open or to close the valve is effected by forces consisting essentially of the relative pressures of the ground and pool water.

* * * * *